US008151786B2

(12) United States Patent
May

(10) Patent No.: US 8,151,786 B2
(45) Date of Patent: Apr. 10, 2012

(54) GAS COOKING APPLIANCE HAVING AN AUTOMATIC GAS SHUTOFF MECHANISM

(75) Inventor: Randall L. May, Plano, TX (US)

(73) Assignee: The Brinkmann Corporation, Dallas, TX (US)

( * ) Notice: Subject to any disclaimer, the term of this patent is extended or adjusted under 35 U.S.C. 154(b) by 281 days.

(21) Appl. No.: 12/713,422

(22) Filed: Feb. 26, 2010

(65) Prior Publication Data

US 2010/0275897 A1 Nov. 4, 2010

Related U.S. Application Data

(60) Provisional application No. 61/174,111, filed on Apr. 30, 2009.

(51) Int. Cl.
*F24C 3/00* (2006.01)

(52) U.S. Cl. ..... 126/42; 126/39 E; 126/40; 126/214 D

(58) Field of Classification Search ..... 126/42, 126/39 E, 9 R, 39 R, 30, 40, 50, 214 D; 99/403, 99/415, 418, 421 A, 421 V; 431/75, 77
See application file for complete search history.

(56) References Cited

U.S. PATENT DOCUMENTS

| | | | | |
|---|---|---|---|---|
| 5,429,111 | A * | 7/1995 | Akamatsu | 126/52 |
| 5,813,321 | A | 9/1998 | Bourgeois | |
| 5,896,810 | A | 4/1999 | Barbour | |
| 6,711,992 | B1 | 3/2004 | McLemore | |
| 6,941,857 | B2 | 9/2005 | McLemore | |
| 7,227,107 | B2 | 6/2007 | McLemore et al. | |
| 7,426,885 | B2 | 9/2008 | McLemore et al. | |
| 7,703,389 | B2 | 4/2010 | McLemore et al. | |
| 2005/0034611 | A1 | 2/2005 | McLemore | |

FOREIGN PATENT DOCUMENTS

JP 5141663 * 6/1993

OTHER PUBLICATIONS

Gardenocity. Watchdog Cooker Deep Fryer, www.yardlover.com/watchdog-cooker-deep-fryer.

* cited by examiner

*Primary Examiner* — Alfred Basichas
(74) *Attorney, Agent, or Firm* — Sheppard, Mullin, Richter & Hampton LLP

(57) ABSTRACT

A gas cooking appliance for cooking a food item, such as a turkey, in a cooking vessel having a bottom surface, such as a pot, the gas cooking appliance configured to be connected to a gas source for permitting a flow of gas to the gas cooking appliance, the appliance having a sensor configured to engage a shielded portion of the bottom surface of the cooking vessel and to shut off or reduce the flow of gas to the appliance in the event that the shielded portion exceeds a predetermined temperature.

24 Claims, 9 Drawing Sheets

GAS COOKING APPLIANCE HAVING AN AUTOMATIC GAS SHUTOFF MECHANISM

CROSS-REFERENCE TO RELATED APPLICATION

The present application claims priority to U.S. Provisional Application No. 61/174,111, entitled "Gas Cooking Appliance Having an Automatic Gas Shutoff Mechanism," filed Apr. 30, 2009, the entire contents of which are herein incorporated by reference.

FIELD OF THE INVENTION

The present invention relates to gas cooking appliances and, more particularly, to gas cooking appliances having an automatic gas shutoff mechanism.

BACKGROUND OF THE INVENTION

Deep frying large poultry items, such as whole turkey, has gained in popularity as a way of cooking that is both quicker than baking and less susceptible to drying out the food. Outdoor cooking appliances for deep frying often include a stock pot that is received on a gas cooker stand, typically supplied by a propane tank. In deep frying a whole turkey, a pot that is sized to receive a whole turkey is filled with a sufficient amount of cooking oil. To avoid human exposure to the oil (e.g., through splashing or direct contact), turkey securement means have been developed, such as those shown in U.S. Pat. Nos. 5,896,810, 5,813,321, and 6,711,992.

Outdoor cooking appliances for deep frying have suffered from the problem that, if the oil gets too hot, the oil can spontaneously combust, causing an oil fire. Thus, some prior appliances have included a gas flow shutoff timer configured to shut off the flow of gas to the appliance after a predetermined amount of time has passed. For example, FIG. 16 of U.S. Pat. No. 7,227,107 shows an outdoor cooker burner assembly having such a gas flow shutoff timer. Such timers can he problematic, because a user can easily reset the timer to restart the flow of gas to the appliance. After the user has restarted the gas flow, the oil can overheat.

Other prior appliances have included a gas flow shutoff system configured to shut off the flow of gas to the appliance in the event that the oil reaches a predetermined temperature. For example, FIG. 20 of U.S. Pat. No. 7,227,107 shows an outdoor cooking assembly having a temperature-based gas flow shutoff system. The shutoff system includes a cooking thermometer having a sensing probe long enough to extend into contact with the cooking fluid from the top edge of the cooking pot. A wire extends from the thermometer to a valve. When the oil reaches a predetermined temperature, the thermometer signals the valve to shut down the gas flow to the cooking assembly. Such shutoff systems can be problematic, because they rely upon the user to clip the thermometer to the top edge of the cooking pot. If the user neglects to attach the thermometer, then the shutoff system is defeated. Additionally, if the user neglects to detach the thermometer after cooking, then the thermometer can interfere with the process of removing the pot from the cooking assembly.

Some prior appliances have included a temperature-based gas flow shutoff system that includes a temperature sensor fastened to the side of the pot. A wire extends from the sensor to a valve. An example is the King Kooker Watchdog Outdoor Cooker model no. 2030 by Metal Fusion, Inc. of Jefferson, La. Similar to the temperature-based shutoff system disclosed in U.S. Pat. No. 7,227,107, the King Kooker shutoff system is problematic, because it relies upon the user to connect the sensor to the shutoff valve, and because it can interfere with the process of removing the pot from the cooking assembly. Additionally, the King Kooker shutoff system requires the user to use a specially-designed pot having a temperature sensor fastened thereto. This requirement interferes with the convenience of being able to use any standard pot with the cooking assembly.

Accordingly, there is a need for a gas cooking appliance having a gas shutoff mechanism that avoids the problems discuss above. More particularly, there is a need for a gas cooking appliance having a gas shutoff mechanism that does not rely upon a timer, that does not rely upon the user to attach a thermometer to a pot, and that does not require the user to use a specially-designed pot having a temperature sensor fastened thereto. The present invention satisfies this and other needs, and provides further related advantages.

SUMMARY OF THE INVENTION

The present invention is embodied in a gas cooking appliance for cooking a food item, such as a turkey, in a cooking vessel having a bottom surface, such as a pot. The gas cooking appliance is configured to be connected to a gas source for permitting a flow of gas to the gas cooking appliance. The appliance has a sensor configured to engage a shielded portion of the bottom surface of the cooking vessel and to shut off or reduce the flow of gas to the appliance in the event that the shielded portion exceeds a predetermined temperature.

More specifically, the gas cooking appliance comprises a cooker body for supporting the cooking vessel; a valve assembly connected to the cooker body for regulating a flow of gas from the gas source to the gas cooking appliance; a burner connected to the valve assembly for receiving a flow of gas from the valve assembly and for emitting a gas flame; a primary heat shield connected to the cooker body for shielding a portion of the bottom surface of the cooking vessel from the gas flame; and a temperature sensor connected to the cooker body and communicatively connected to the valve assembly, the temperature sensor configured to engage the shielded portion of the bottom surface of the cooking vessel. The valve assembly is configured to stop or reduce a flow of gas from the gas source to the gas cooking appliance in the event that the shielded portion of the bottom surface of the cooking vessel exceeds a predetermined temperature.

In one embodiment, the burner has a plurality of openings for permitting gas received within the burner to escape and create the gas flame. The plurality of openings in the burner are positioned to inhibit the escape of gas toward the shielded portion of the bottom surface of the cooking vessel. To this end, the plurality of openings in the burner are arranged in an arc around a central axis, leaving a portion of the burner proximate the temperature sensor that is substantially free of openings. The portion of the burner that is substantially free of openings subtends an angle of between approximately 30 degrees arid approximately 90 degrees with respect to the central axis.

In another embodiment, the cooker body comprises a circular upper portion having a first diameter, a circular lower portion having a second diameter smaller than the first diameter, and a plurality of cooking vessel supports, each cooking vessel support having a first end connected to the upper portion of the cooker body and a second end connected to the upper portion of the cooker body. The primary heat shield has an upper edge abutting one of the plurality of cooking vessel supports, a first outer edge abutting the lower portion of the cooker body, and a second outer edge abutting the lower portion of the cooker body. A secondary heat shield is positioned between the primary heat shield and the lower portion of the cooker body, the secondary heat shield having a first side edge abutting the lower portion of the cooker body and a second side edge abutting the lower portion of the cooker body.

In a further embodiment, the temperature sensor is spring-loaded and configured to be vertically displaced or depressed by the weight of the cooking vessel when placed on the cooker body. A spring can he configured to exert an upward force upon the temperature sensor when the temperature sensor is vertically displaced.

The present invention is also embodied in a gas cooking appliance comprising a cooker body for supporting the cooking vessel; a valve assembly connected to the cooker body for regulating a flow of gas from the gas source to the gas cooking appliance; a burner connected to the valve assembly for receiving a flow of gas from the valve assembly and for emitting a gas flame; and a temperature sensor connected to the cooker body and communicatively connected to the valve assembly. The burner has a plurality of openings for permitting gas received within the burner to escape and create the gas flame. The plurality of openings in the burner are positioned to inhibit the escape of gas toward the temperature sensor. The valve assembly is configured to stop or reduce a flow of gas from the gas source to the gas cooking appliance in the event that the temperature sensor engages a surface exceeding a predetermined temperature.

Other features and advantages of the invention will become apparent from the following detailed description of the preferred embodiments taken with the accompanying drawings, which illustrate, by way of example, the principles of the invention.

BRIEF DESCRIPTION OF THE DRAWINGS

Embodiments of the present invention will now he described, by way of example only, with reference to the following drawings.

DETAILED DESCRIPTION OF THE PREFERRED EMBODIMENTS

Figure 1:
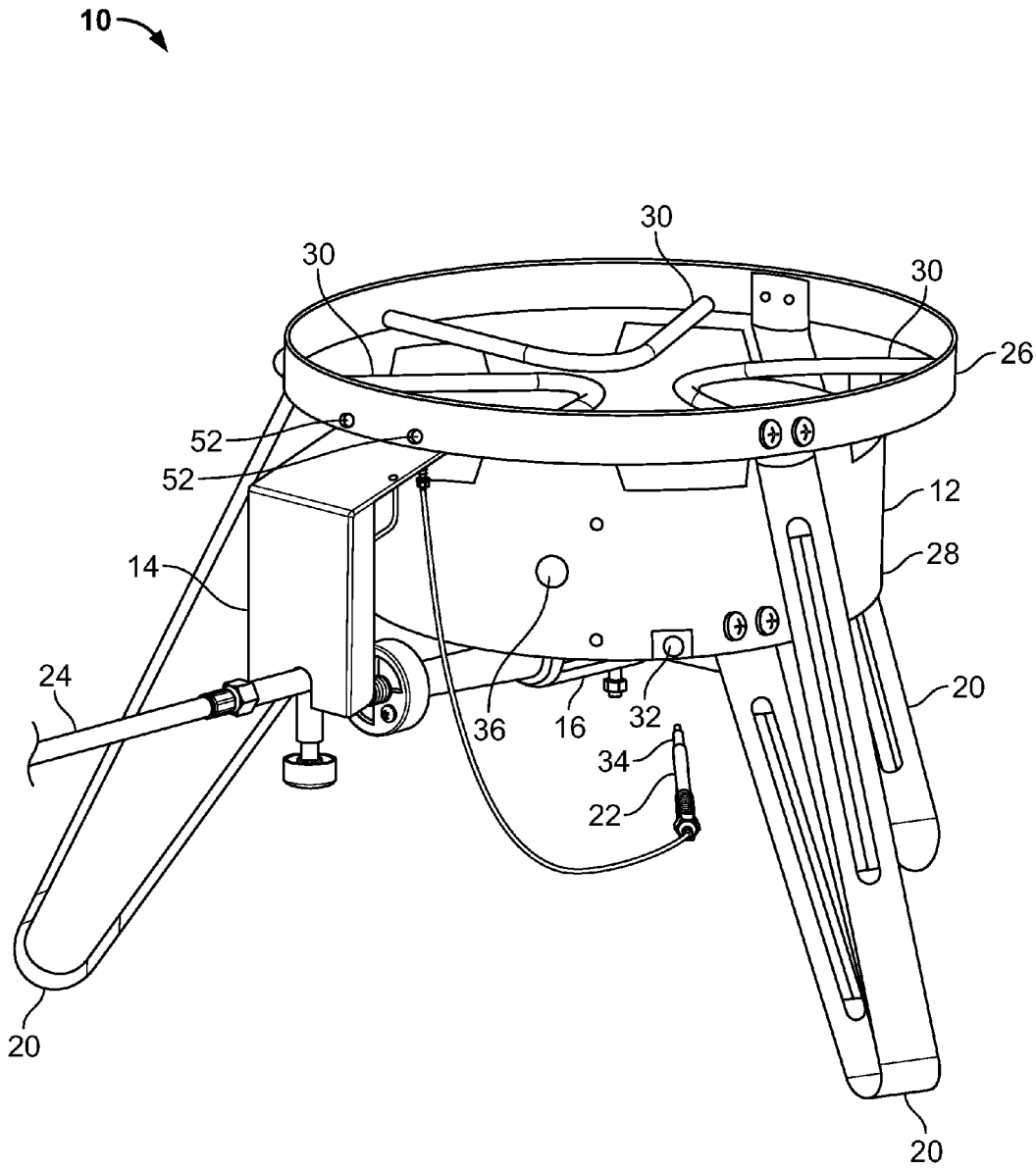
FIG. 1 is a perspective view of a gas cooking appliance, in accordance with an embodiment of the present invention.

Referring now to the drawings, and particularly to FIG. 1 thereof, there is shown by way of example, and not limitation, a gas cooking appliance indicated generally by reference numeral 10 in accordance with an embodiment of the present invention. The appliance comprises a cooker body 12, a hose control panel 14, a burner 16, a heat shield 18 (see FIG. 7), three generally U-shaped legs 20, and a flameout probe 22. The appliance is configured to be connected via a hose 24 to a gas source such as a propane tank (shown in FIG. 8) for permitting a flow of gas to the appliance.

The cooker body 12 is made of a metal or metal alloy having a high heat tolerance. In one embodiment, the cooker body comprises a generally cylindrical upper portion 26 having a diameter of approximately 12 inches and a height of approximately 1 inch, and a generally cylindrical lower portion 28 having a diameter of approximately 10 inches and a height of approximately 4.5 inches. The present invention encompasses gas cooking appliances comprising cooker bodies having different measurements. The upper portion includes three generally U-shaped pot supports 30 extending inward toward the central axis of the cooker body for supporting a pot on top of the cooker body. Each pot support has a first and second end secured to the upper portion of the cooker body. The bottom portion includes a flameout probe hole 32 through which a user can insert the flameout probe 22 for positioning the tip 34 of the probe above the burner 16. The bottom portion also includes a lighting hole 36 through which a user can insert a match to light the burner.

Figure 2:
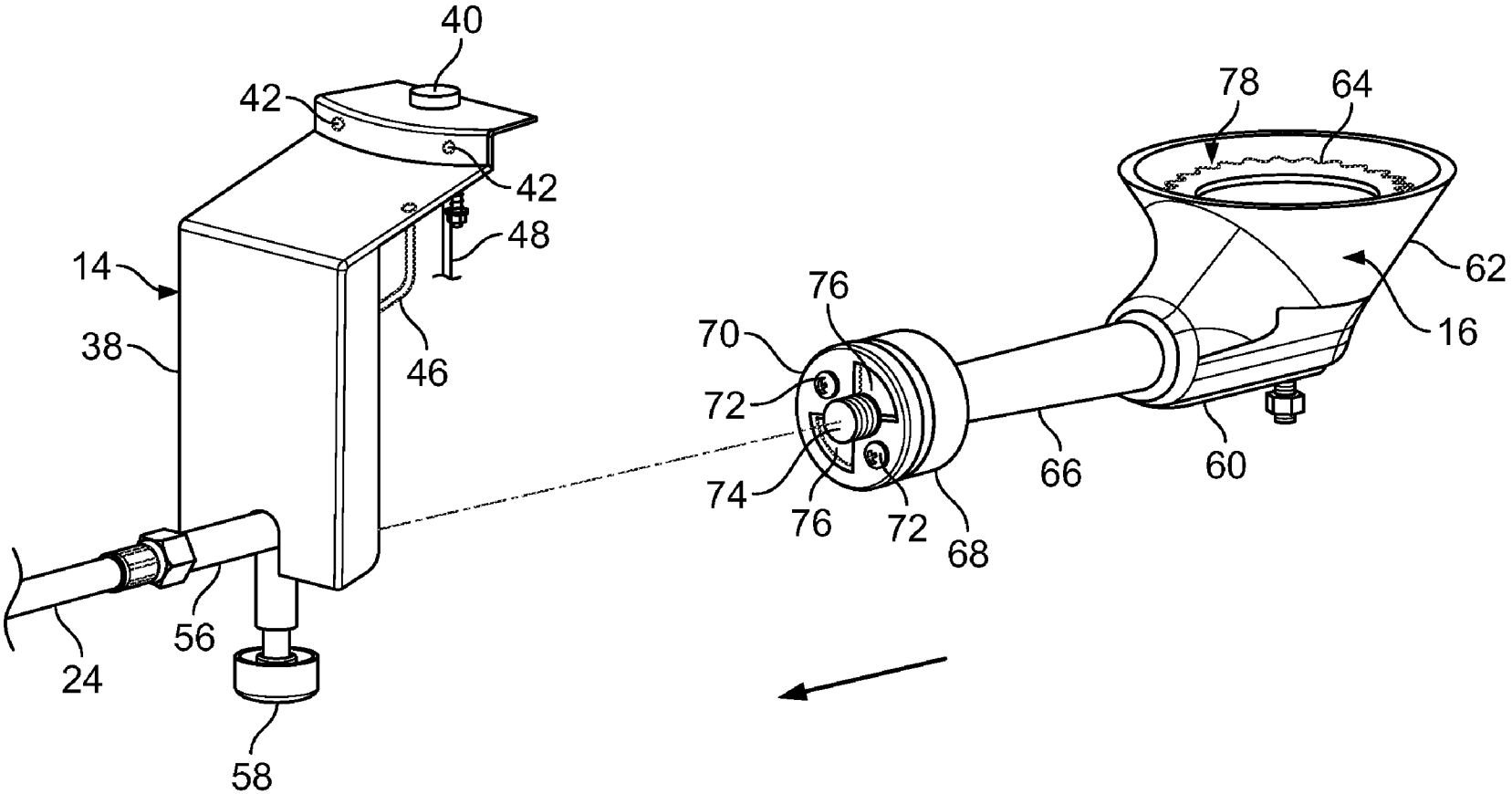
FIG. 2 is an exploded view of a hose control panel and burner for the gas cooking appliance of FIG. 1, in accordance with an embodiment of the present invention.
Figure 3:
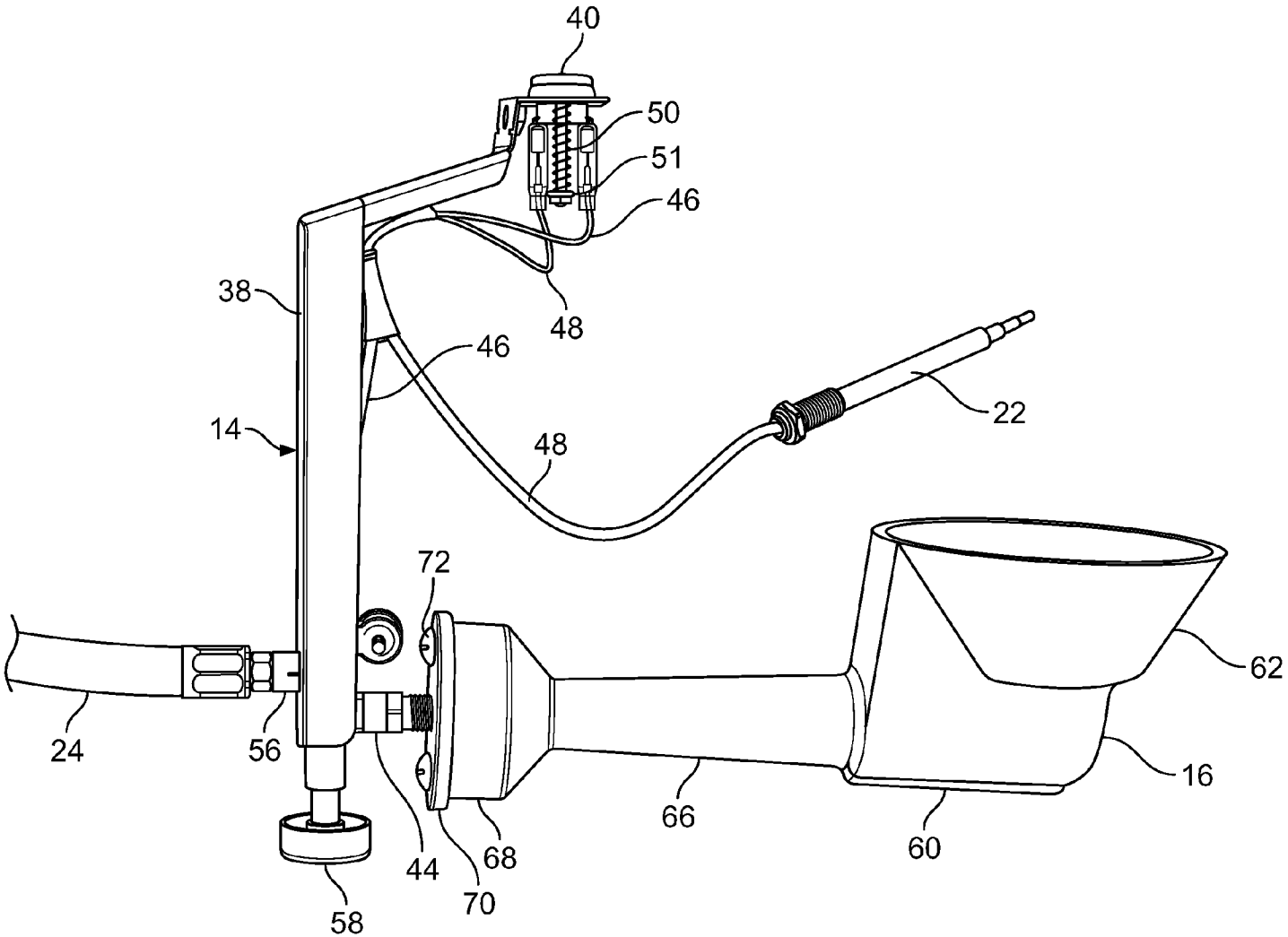
FIG. 3 is a side elevation view of a hose control panel and burner for the gas cooking appliance of FIG. 1, in accordance with an embodiment of the present invention.
Figure 4:
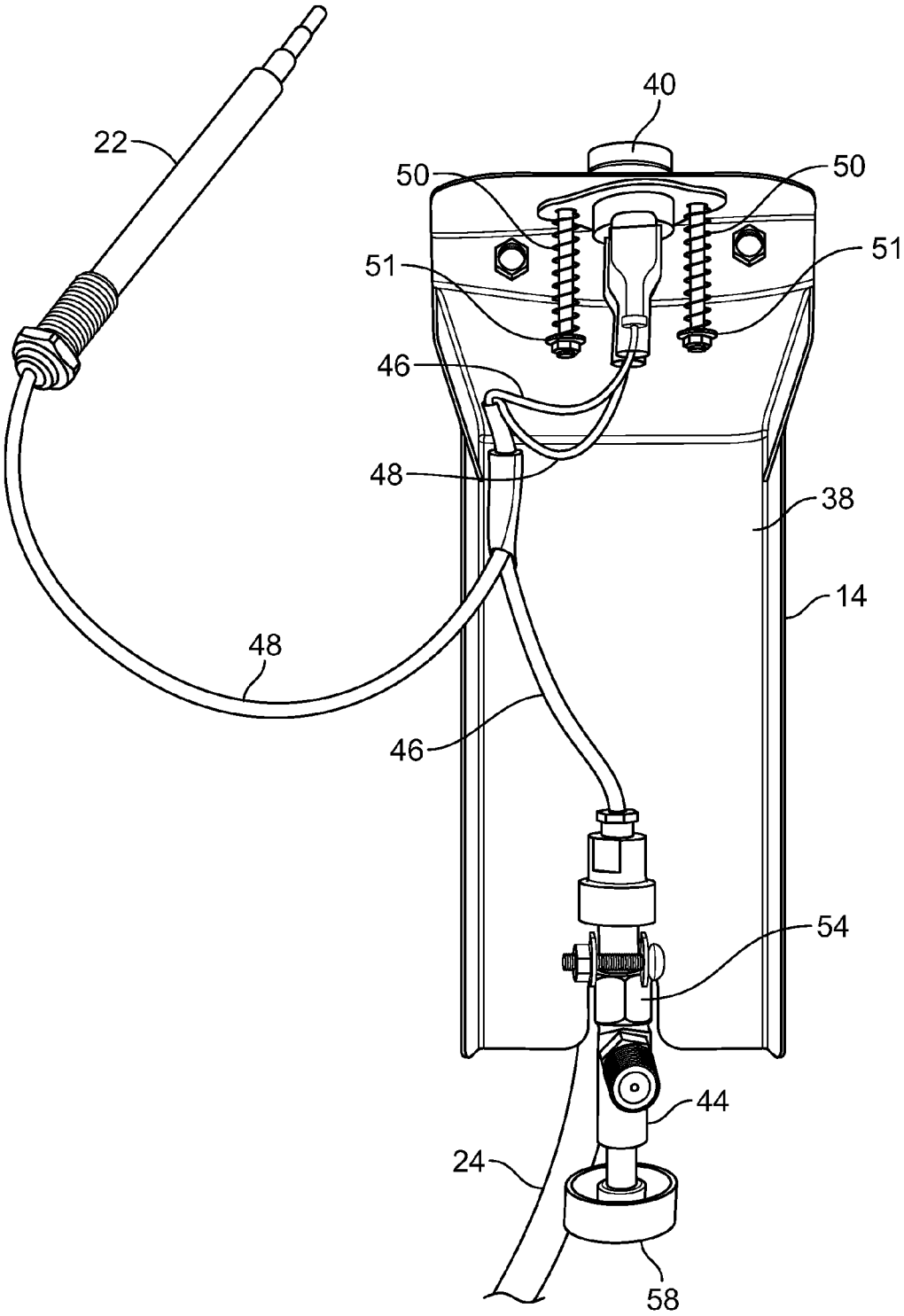
FIG. 4 is an inside elevation view of a hose control panel for the gas cooking appliance of FIG. 1, in accordance with an embodiment of the present invention.

With reference to FIGS. 2-4, there is shown the hose control panel 14 and burner 16 for the gas cooking appliance 10 of FIG. 1, in accordance with an embodiment of the present invention. The control panel comprises a support bracket 38, a spring-loaded temperature sensor 40, a pair of mounting holes 42, a valve assembly 44, a valve wire 46, and a flameout probe wire 48 that leads to the flameout probe 22. The support bracket is made of a metal or metal alloy having a high heat tolerance. The temperature sensor can be a simple, bi-metallic, on-off switch set to open up when it engages a surface that exceeds a predetermined temperature (e.g., 400 degrees Fahrenheit). In other embodiments, a more complex temperature sensor or thermometer can be used to generate an electrical signal that the predetermined temperature has been exceeded. The temperature sensor is configured to be vertically displaced when a pot is supported upon the cooker body. A spring 50 attached to a spring retainer 51 exerts an upward force on the temperature sensor to help ensure that the temperature sensor remains engaged to a pot supported on top of the cooker body 12. The mounting holes 42 allow the control panel to be attached to the upper portion 26 of the cooker body using a pair of fasteners, such as bolts 52 (FIG. 1).

The valve assembly 44 includes a conventional valve 54, such as a thermocouple valve, configured to regulate the flow of gas to the gas cooking appliance 10, a pipe 56 configured to be connected via the hose 24 to a gas source for permitting the flow of gas to the appliance, and a spring-loaded start button 58 configured to be depressed in an upward direction for starting the flow of gas to the appliance. In one embodiment, the valve is a simple two-way valve not designed to precisely control an intermediate degree of flow (i.e., the valve is either open or shut, and regulates the flow of gas so that the gas is either flowing or not flowing). In other embodiments, the valve can be a more complex two-way valve designed to regulate varying amounts of flow. The valve wire 46 communicatively connects the temperature sensor 40 to the valve assembly for shutting off the flow of gas to the appliance in the event that the temperature sensor senses an excessive temperature. The flameout probe wire 48 communicatively connects the flameout probe 22 to the temperature sensor (and thus to the valve assembly) for shutting off the flow of gas to the appliance in a known manner in the event the flameout probe senses that the flame coining from the burner 16 has been extinguished.

In one embodiment, the flameout probe 22 is a conventional thermocouple and the valve 54 is a conventional thermocouple valve having two positions (on and off). A thermocouple is a device that produces voltage or electricity when heated. More specifically, the tip of the flameout probe can be made of two different metals, the junction of which produces a voltage when heated. The flameout probe thus can act as a power supply that holds open the valve to allow gas to reach the burner 16. In this embodiment, the flameout probe and temperature sensor 40 are wired in series with the valve. The temperature sensor 40 acts as a switch that shuts off the flow of gas when it senses a predetermined temperature. Should the flame go out for other reasons (wind, etc.), the thermocouple will cool down and stop producing electricity to hold the valve open. Thus, either an excessive temperature condition or a flameout condition will cause the valve to completely shut off the flow of gas to the burner.

Figure 5:
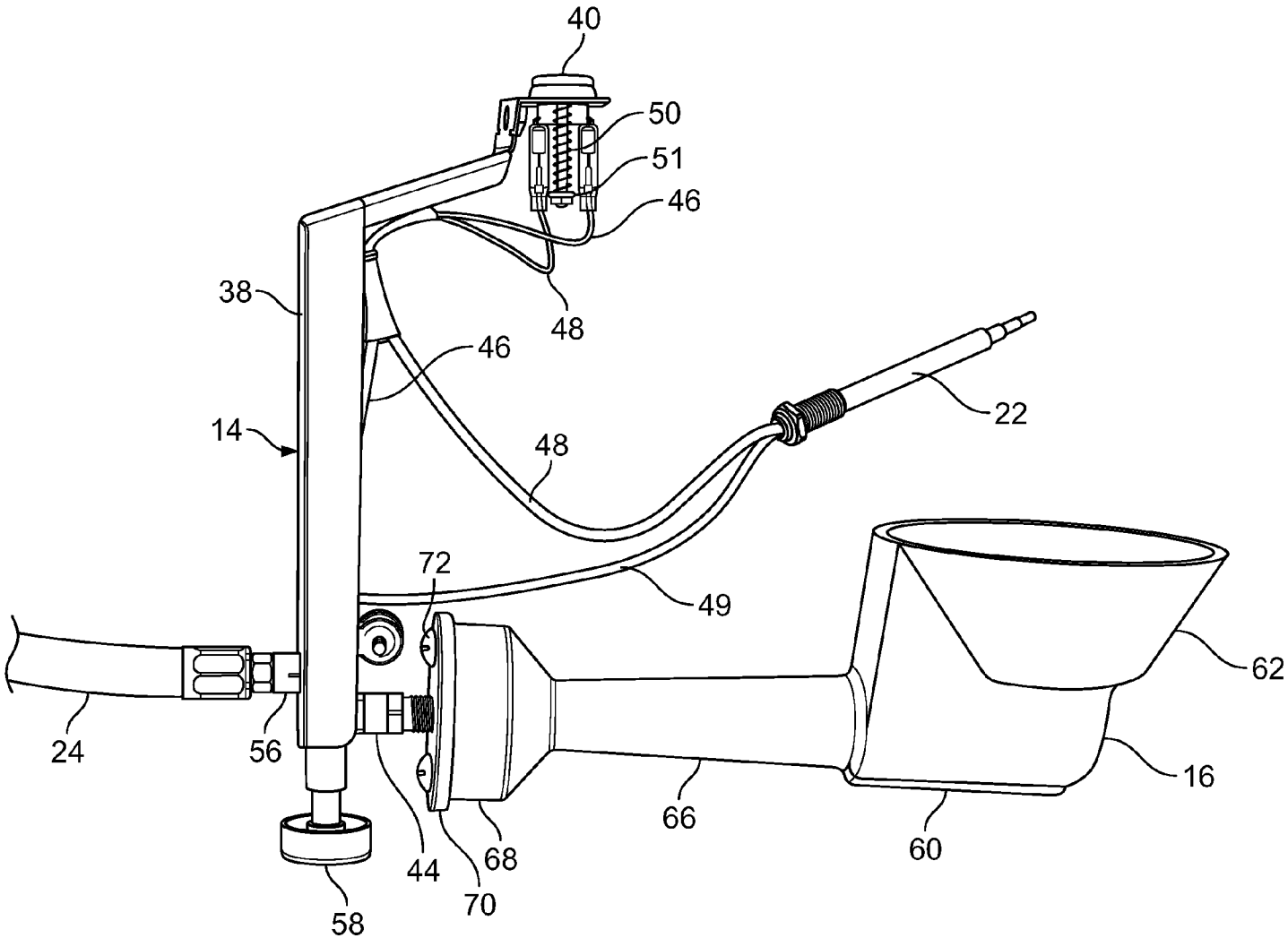
FIG. 5 is a side elevation view of an alternative hose control panel and burner for the gas cooking appliance of FIG. 1, in accordance with an embodiment of the present invention.

In another embodiment, the valve 54 is a three-position thermocouple valve (high, low, and off). Using such a valve, the flow of gas to the burner 16 can be reduced if the temperature sensor 40 senses an excessive temperature. In this embodiment, the flameout probe 22 is connected by an additional wire 49 to the valve (see FIG. 5). The flameout probe holds open the valve in the high position when the temperature sensor is closed, and in the low position when the temperature sensor is open. Thus, when the temperature sensor is activated by an excessive temperature, the thermocouple valve changes from the high position to the low position, reducing the flow of gas to the burner. If the flame on the burner were to be extinguished, the flameout probe would cool and cause the valve to shut off completely.

The burner 16 comprises a burner head 60 having a generally cone-shaped upper portion 62, a burner port 64 received within the upper portion of the burner head, a burner tube 66 having an enlarged upstream end 68, and a rotatable air shutter 70 fastened to the enlarged upstream end of the burner tube using a pair of fasteners, such as screws 72. The burner head is made of a metal or metal alloy having a high heat tolerance, such as cast iron. The upper portion of the burner head has a diameter of approximately 3.5 inches at its uppermost extent. The present invention encompasses burners having different measurements.

With reference again to FIGS. 2 and 3, the rotatable air shutter 70 has a central hole 74 for permitting the flow of gas to enter the burner tube 66, and two air holes 76 displaced radially from the central hole for permitting air to enter the burner tube and mix with the gas. By rotating the air shutter, a user can control the amount of air that mixes with the gas and thus achieve an optimal blue flame coming out of the burner 16.

The burner port 64 is a generally bowl-shaped piece having a diameter of approximately three inches and is made of a metal or metal alloy having a high heat tolerance, such as cast iron. The outer surface of the burner port has a plurality of longitudinally-extending grooves 78 formed therein. When the burner port has been received within the upper portion 62 of the burner head 60, the grooves form a plurality of openings it allowing gas received within the burner 16 to escape toward the bottom surface of the pot and create a flame. Each groove is approximately one inch in length and a quarter inch in width. The present invention encompasses burner ports having different measurements.

Figure 6:
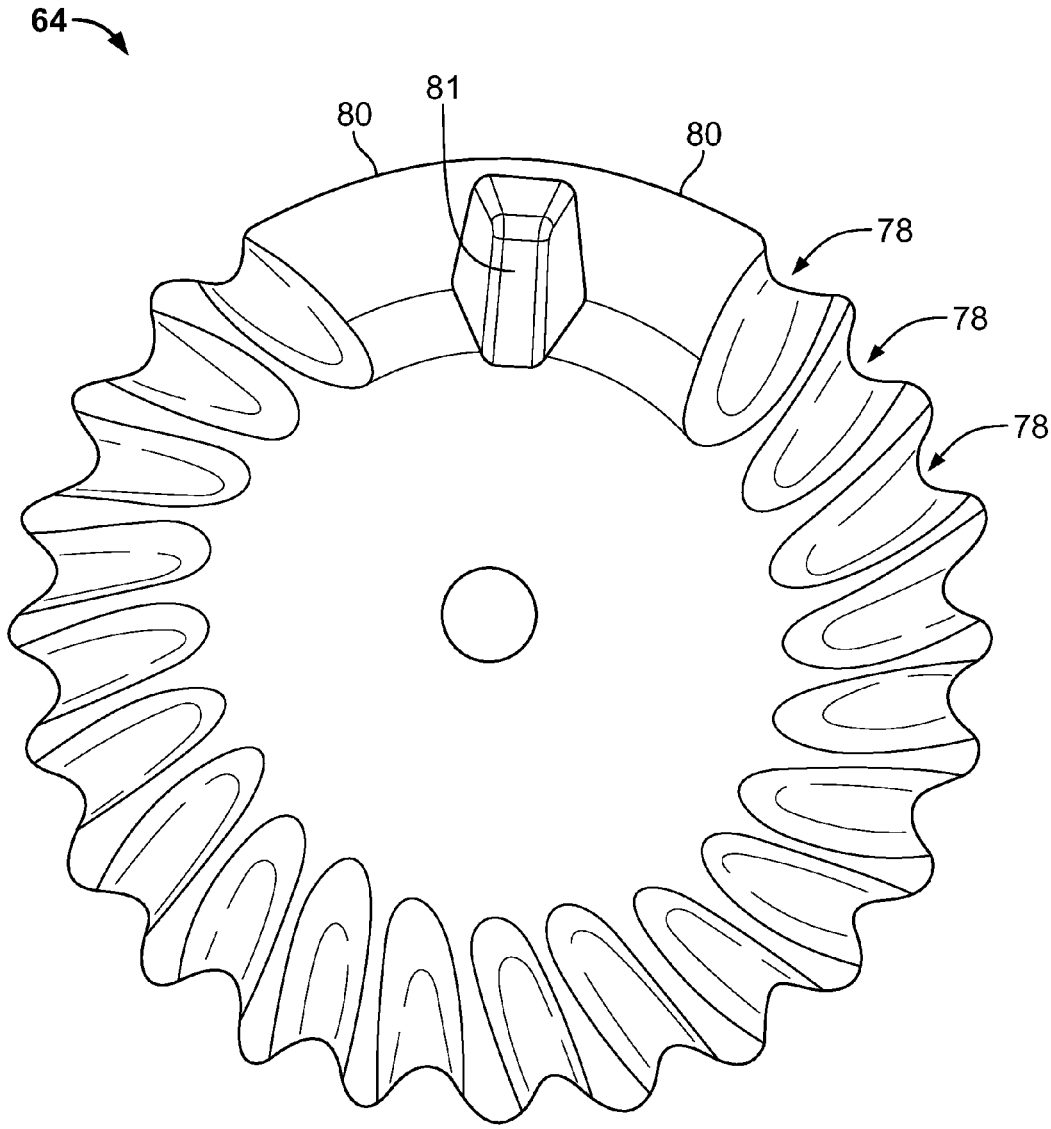
FIG. 6 is a bottom plan view of a burner port for the gas cooking appliance of FIG. 1, in accordance with an embodiment of the present invention.
Figure 7:
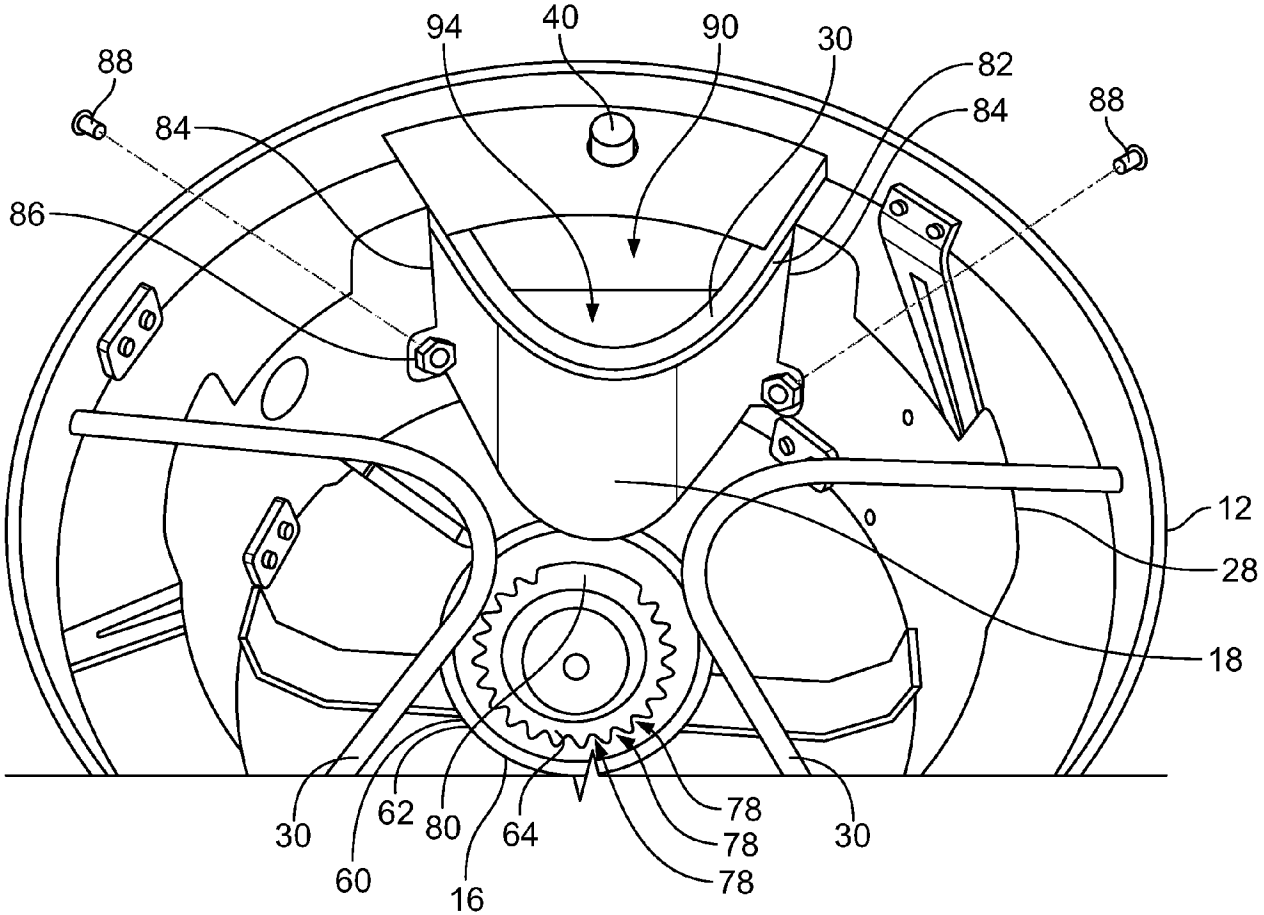
FIG. 7 is a partial perspective view of the gas cooking appliance of FIG. 1, showing a heat shield and burner port in accordance with an embodiment of the present invention.

The grooves 78 formed in the outer surface of the burner port 64 are more easily seen in FIG. 6 and in FIG. 7, which also shows the heat shield 18. The grooves extend around approximately 290 degrees of the burner port, leaving a groove-free portion 80 subtending an angle of preferably between approximately 90 degrees and approximately 30 degrees, and more preferably between approximately 75 degrees and approximately 45 degrees, and most preferably approximately 60 degrees. The groove-free portion is positioned proximate the side of the upper portion 62 of the burner head 60 closest to the temperature sensor 40. A notch 81 can be formed in the bottom of the burner port for correctly aligning the burner port with the temperature sensor. In this configuration, the flame coming out of the burner 16 is weakest in the sector proximate the temperature sensor, because the groove-free portion inhibits the flow of gas toward the temperature sensor. It has been found that when the groove-free portion subtends an angle of approximately 60 degrees, the flame is able to provide sufficiently uniform heating of the bottom of a pot supported on top of the cooker body for cooking food, while largely shielding the temperature sensor from the direct heat of the flame (which could damage the temperature sensor and/or cause the switch in the temperature sensor to open up prematurely).

The heat shield 18 is a generally U-shaped sheet of metal or metal alloy having a high heat tolerance. In one embodiment, the heat shield has an upper edge 82 that abuts one of the generally U-shaped pot supports 30 and two outer edges 84 that abut the lower portion 28 of the cooker body 12. The temperature sensor 40 is positioned proximate the sector defined by the heat shield and the lower portion of the cooker body, so that the temperature sensor (and the portion of the bottom surface of the pot to which the temperature sensor is engaged) are further shielded from the flame coming out of the burner 16. The heat shield has two pre-attached nuts 86, each configured to receive a bolt 88 for attaching the heat shield to the lower portion of the cooker body.

In addition to the heat shield 18, a secondary heat shield 90 can be attached to the lower portion 28 of the cooker body 12 for providing further shielding of the temperature sensor 40. In one embodiment, the secondary heat shield 90 is a generally flat sheet of metal or metal alloy having a high heat tolerance. It has two side edges that are attached to the lower portion of the cooker body proximate the locations where the two outer edges 84 of the heat shield 18 abut the cooker body. The secondary heat shield 90 extends generally vertically between the heat shield 18 and the lower portion of the cooker body, defining a space 94 substantially bounded by the heat shield 18 and secondary heat shield 90.

Figure 8:
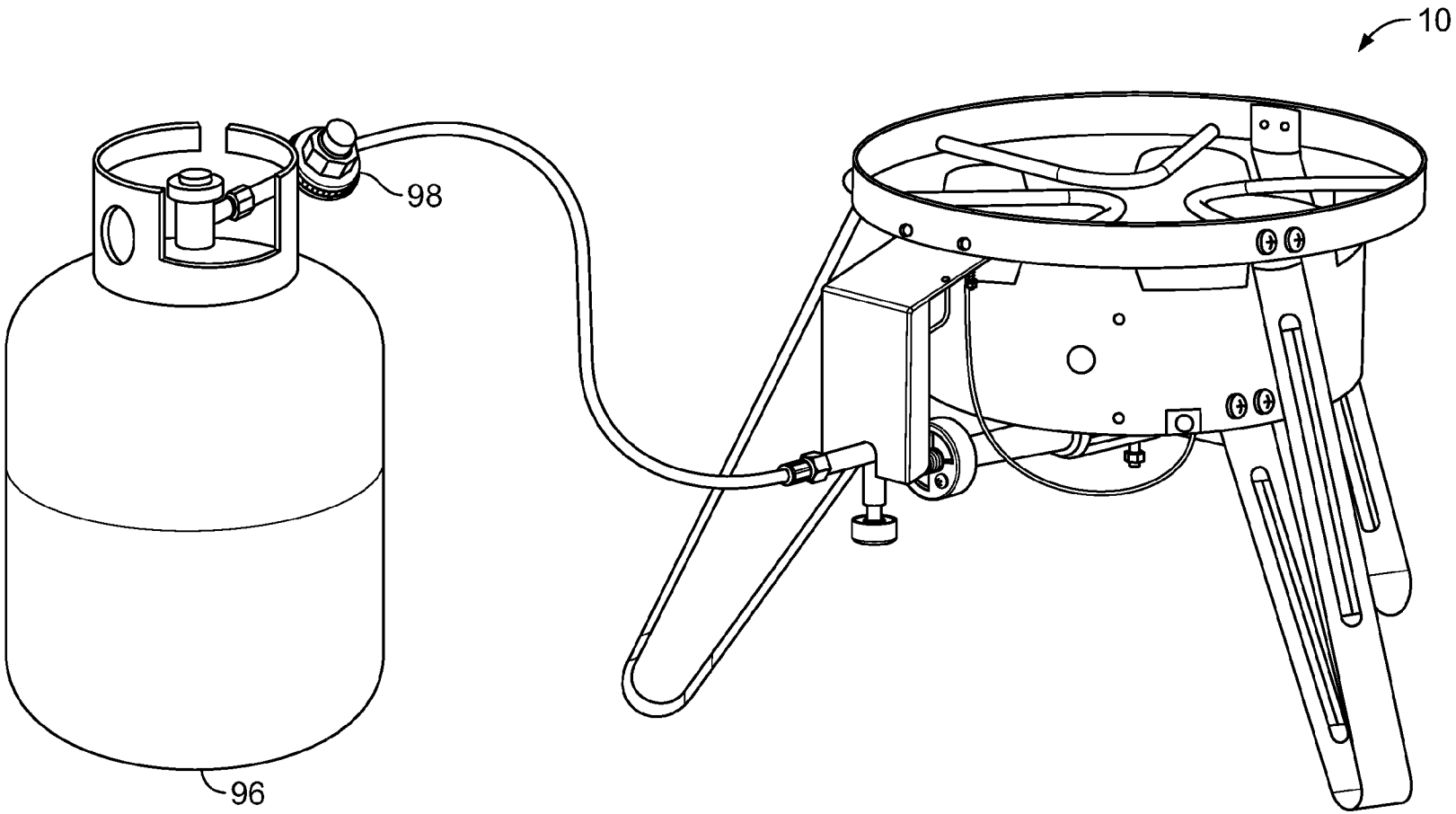
FIG. 8 is a perspective view of the gas cooking appliance of FIG. 1 connected to a gas source, in accordance with an embodiment of the present invention.

With reference to FIG. 8, there is shown the gas cooking appliance 10 connected to a gas source 96, in accordance with an embodiment of the present invention. The gas source may be a liquid petroleum (LP) gas cylinder, as shown. The gas source has a regulator control knob 98 for adjusting the flame height.

Figure 9:
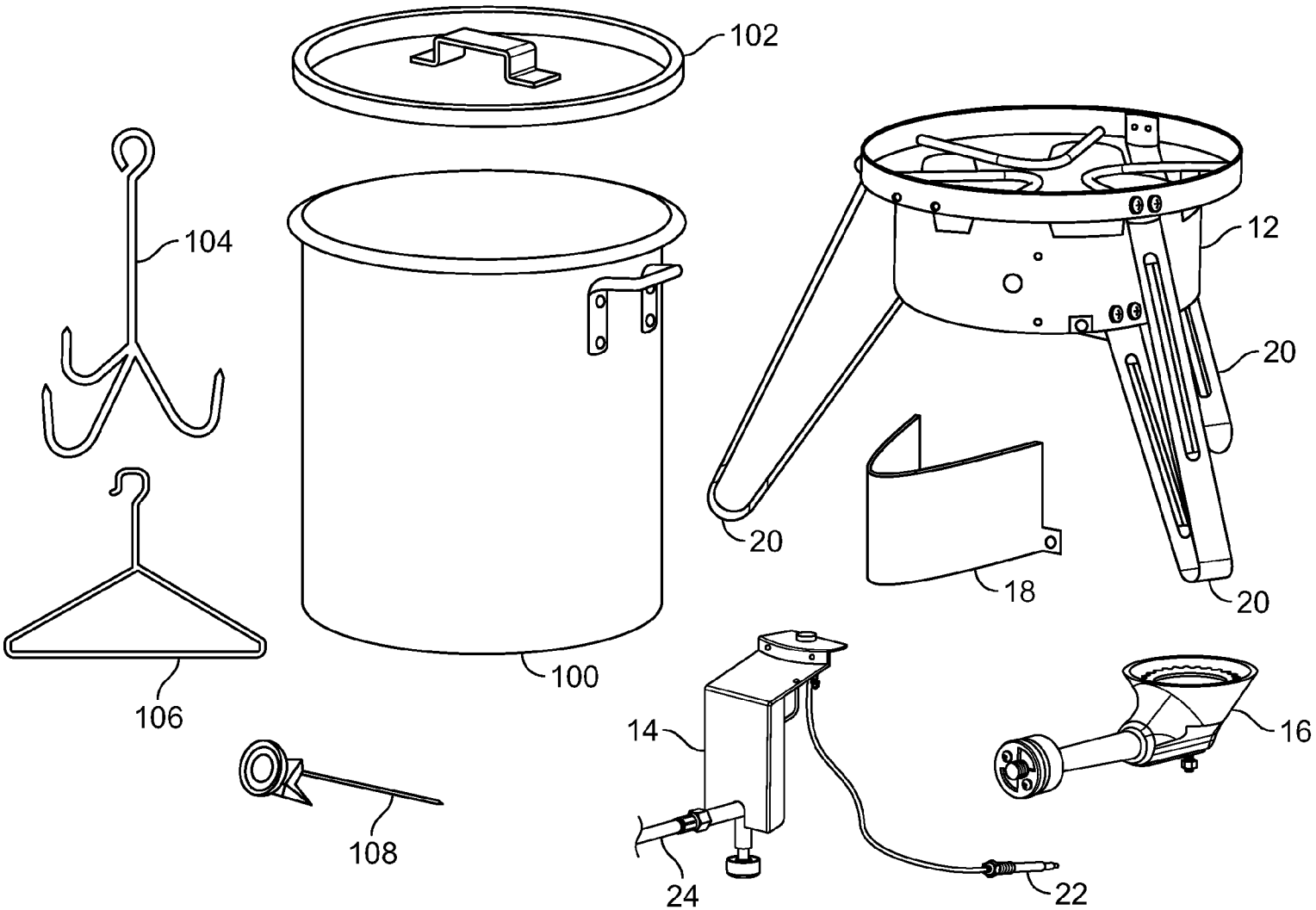
FIG. 9 is an exploded view of the gas cooking appliance of FIG. 1 and accessories therefor, in accordance with an embodiment of the present invention.

With reference to FIG. 9, there is shown an exploded view of the gas cooking appliance 10 and accessories therefor, in accordance with an embodiment of the present invention. The accessories may include a cooking vessel (such as a pot 100 having a lid 102), a turkey stand 104 and hanger 106 for safely placing a poultry item in the cooking vessel and later removing the poultry item from the cooking vessel, and a deep fry thermometer 108 for providing the user with a visible indication of the temperature of oil placed in the cooking vessel.

The present invention has been described above in terms of presently preferred embodiments so that an understanding of the present invention can be conveyed. However, there are other embodiments not specifically described herein for which the present invention is applicable. Therefore, the present invention should not to he seen as limited to the forms shown, which is to be considered illustrative rather than restrictive.

What is claimed is:

1. A gas cooking appliance for cooking a food item in a cooking vessel having a bottom surface, the gas cooking appliance configured to be connected to a gas source for permitting a flow of gas to the gas cooking appliance, the gas cooking appliance comprising:

a cooker body for supporting the cooking vessel;

a valve assembly connected to the cooker body for regulating a flow of gas from the gas source to the gas cooking appliance;

a burner connected to the valve assembly for receiving a flow of gas from the valve assembly and for emitting a gas flame;

a temperature sensor connected to the cooker body and communicatively connected to the valve assembly, the temperature sensor configured to engage a portion of the bottom surface of the cooking vessel; and a primary heat shield connected to the cooker body for shielding the temperature sensor from the gas flame;

wherein the valve assembly is configured to stop or reduce a flow of gas from the gas source to the gas cooking appliance in the event that the temperature sensor engages a surface exceeding a predetermined temperature.

2. The gas cooking appliance of claim 1, wherein:

the burner has a plurality of openings for permitting gas received within the burner to escape and create the gas flame; and the plurality of openings in the burner are positioned to inhibit the escape of gas toward the temperature sensor.

3. The gas cooking appliance of claim 2, wherein the plurality of openings in the burner are arranged in a generally circular arc around a central axis, leaving a portion of the burner proximate the temperature sensor that is substantially free of openings.

4. The gas cooking appliance of claim 3, wherein the portion of the burner that is substantially free of openings subtends an angle of between approximately 30 degrees and approximately 90 degrees with respect to the central axis.

5. The gas cooking appliance of claim 1, wherein:

the cooker body comprises a circular upper portion having a first diameter, a circular lower portion having a second diameter smaller than the first diameter, and a plurality of cooking vessel supports, each cooking vessel support having a first end connected to the upper portion of the cooker body and a second end connected to the upper portion of the cooker body; and the primary heat shield has an upper edge abutting one of the plurality of cooking vessel supports, a first outer edge abutting the lower portion of the cooker body, and a second outer edge abutting the lower portion of the cooker body.

6. The gas cooking appliance of claim 5, further comprising a secondary heat shield positioned between the primary heat shield and the lower portion of the cooker body, the secondary heat shield having a first side edge abutting the lower portion of the cooker body and a second side edge abutting the lower portion of the cooker body.

7. The gas cooking appliance of claim 1, wherein the temperature sensor is configured to be vertically displaced by the cooking vessel when the cooking vessel is placed upon the cooker body.

8. The gas cooking appliance of claim 7, wherein the temperature sensor is spring-biased in an upward direction.

9. A gas cooking appliance for cooking a food item in a cooking vessel, the gas cooking appliance configured to be connected to a gas source for permitting a flow of gas to the gas cooking appliance, the gas cooking appliance comprising:

a cooker body for supporting the cooking vessel;

a valve assembly connected to the cooker body for regulating a flow of gas from the gas source to the gas cooking appliance;

a burner connected to the valve assembly for receiving a flow of gas from the valve assembly and for emitting a gas flame; and a temperature sensor connected to the cooker body and communicatively connected to the valve assembly;

wherein the burner has a plurality of openings for permitting gas received within the burner to escape and create the gas flame;

wherein the plurality of openings in the burner are positioned to inhibit the escape of gas toward the temperature sensor; and wherein the valve assembly is configured to stop or reduce a flow of gas from the gas source to the gas cooking appliance in the event that the temperature sensor engages a surface exceeding a predetermined temperature.

10. The gas cooking appliance of claim 9, wherein the plurality of openings in the burner are arranged in a generally circular arc around a central axis, leaving a portion of the burner proximate the temperature sensor that is substantially free of openings.

11. The gas cooking appliance of claim 10, wherein the portion of the burner that is substantially free of openings subtends an angle of between approximately 30 degrees and approximately 90 degrees with respect to the central axis.

12. The gas cooking appliance of claim 9, further comprising a primary heat shield connected to the cooker body for shielding the temperature sensor from the gas flame.

13. The gas cooking appliance of claim 12, wherein:

the cooker body comprises a circular upper portion having a first diameter, a circular lower portion having a second diameter smaller than the first diameter, and a plurality of cooking vessel supports, each cooking vessel support having a first end connected to the upper portion of the cooker body and a second end connected to the upper portion of the cooker body; and the primary heat shield has an upper edge abutting one of the plurality of cooking vessel supports, a first outer edge abutting the lower portion of the cooker body, and a second outer edge abutting the lower portion of the cooker body.

14. The gas cooking appliance of claim 13, further comprising a secondary heat shield positioned between the primary heat shield and the lower portion of the cooker body, the secondary heat shield having a first side edge abutting the lower portion of the cooker body and a second side edge abutting the lower portion of the cooker body.

15. The gas cooking appliance of claim 9, wherein the temperature sensor is configured to be vertically displaced by the cooking vessel when the cooking vessel is placed upon the cooker body.

16. The gas cooking appliance of claim 15, wherein the temperature sensor is spring-biased in an upward direction.

17. A gas cooking appliance for cooking a food item, the gas cooking appliance configured to be connected to a gas source for permitting a flow of gas to the gas cooking appliance, the gas cooking appliance comprising:

a cooking vessel having a bottom surface;

a cooker body for supporting the cooking vessel;

a valve assembly connected to the cooker body for regulating a flow of gas from the gas source to the gas cooking appliance;

a burner connected to the valve assembly for receiving a flow of gas from the valve assembly and for emitting a gas flame;

a temperature sensor connected to the cooker body and communicatively connected to the valve assembly, the temperature sensor configured to engage a portion of the bottom surface of the cooking vessel; and a primary heat shield connected to the cooker body for shielding the temperature sensor from the gas flame;

wherein the valve assembly is configured to stop or reduce a flow of gas from the gas source to the gas cooking appliance in the event that the temperature sensor engages a surface exceeding a predetermined temperature.

18. The gas cooking appliance of claim 17, wherein:

the burner has a plurality of openings for permitting gas received within the burner to escape and create the gas flame; and the plurality of openings in the burner are positioned to inhibit the escape of gas toward the temperature sensor.

19. The gas cooking appliance of claim 18, wherein the plurality of openings in the burner are arranged in a generally circular arc around a central axis, leaving a portion of the burner proximate the temperature sensor that is substantially free of openings.

20. The gas cooking appliance of claim 19, wherein the portion of the burner that is substantially free of openings subtends an angle of between approximately 30 degrees and approximately 90 degrees with respect to the central axis.

21. The gas cooking appliance of claim 17, wherein:

the cooker body comprises a circular upper portion having a first diameter, a circular lower portion having a second diameter smaller than the first diameter, and a plurality of cooking vessel supports, each cooking vessel support having a first end connected to the upper portion of the cooker body and a second end connected to the upper portion of the cooker body; and the primary heat shield has an upper edge abutting one of the plurality of cooking vessel supports, a first outer edge abutting the lower portion of the cooker body, and a second outer edge abutting the lower portion of the cooker body.

22. The gas cooking appliance of claim 21, further comprising a secondary heat shield positioned between the primary heat shield and the lower portion of the cooker body, the secondary heat shield having a first side edge abutting the lower portion of the cooker body and a second side edge abutting the lower portion of the cooker body.

23. The gas cooking appliance of claim 17, wherein the temperature sensor is configured to be vertically displaced by the cooking vessel when the cooking vessel is placed upon the cooker body.

24. The gas cooking appliance of claim 23, further comprising a spring configured to exert an upward force upon the temperature sensor when the temperature sensor is vertically displaced.

* * * * *

UNITED STATES PATENT AND TRADEMARK OFFICE

CERTIFICATE OF CORRECTION

PATENT NO. : 8,151,786 B2
APPLICATION NO. : 12/713422
DATED : April 10, 2012
INVENTOR(S) : Randall L. May It is certified that error appears in the above-identified patent and that said Letters Patent is hereby corrected as shown below:

Column 2, line 56, “arid” should be -- and --.

Column 3, line 11, “he” should be -- be --.

Column 3, line 39, “he” should be -- be --.

Column 5, line 7, “coining” should be -- coming --.

Column 5, line 66, “it” should be -- for --.

Column 7, line 6, “he” should be -- be --.

Signed and Sealed this
Second Day of October, 2012

David J. Kappos
*Director of the United States Patent and Trademark Office*